US006174368B1

(12) United States Patent
Eichinger et al.

(10) Patent No.: US 6,174,368 B1
(45) **Date of Patent: *Jan. 16, 2001**

(54) STATIONARY SLIDING BAR

(75) Inventors: Kurt Eichinger, Wilhelmsburg; Walter Humplstötter, Pötten, both of (AT)

(73) Assignee: Voith Sulzer Papiermaschinen GmbH, Heidenheim (DE)

( * ) Notice: Under 35 U.S.C. 154(b), the term of this patent shall be extended for 0 days.

This patent is subject to a terminal disclaimer.

(21) Appl. No.: 09/223,420

(22) Filed: Dec. 30, 1998

Related U.S. Application Data

(63) Continuation of application No. 08/648,584, filed on Jun. 3, 1996, now Pat. No. 5,855,672.

(30) Foreign Application Priority Data

May 20, 1995 (DE) ..... 295 08 421 U

(51) Int. Cl.[7] ..... B05C 11/00
(52) U.S. Cl. ..... 118/68; 118/62
(58) Field of Search ..... 226/199, 97.1, 226/97.3; 34/640, 273, 421; 118/62, 65, 64, 21, 68, 58, 123; 242/615.11, 615.12, 615.4

(56) References Cited

U.S. PATENT DOCUMENTS

| | | | |
|---|---|---|---|
| 3,106,365 | 10/1963 | Karr | 266/199 |
| 4,697,728 | 10/1987 | Sawyer et al. | 226/196 |
| 4,824,002 | 4/1989 | Ford et al. | 226/197 |
| 4,870,920 | 10/1989 | Kageyama et al. | 118/103 |
| 5,172,844 * | 12/1992 | Mueller . | |
| 5,230,165 | 7/1993 | Beisswanger | 34/60 |
| 5,401,314 | 3/1995 | Kustermann | 118/206 |
| 5,496,406 | 3/1996 | Beisswanger et al. | 118/643 |

FOREIGN PATENT DOCUMENTS

| | | |
|---|---|---|
| 1 256 990 | 12/1967 | (DE) . |
| 2 121 856 | 11/1972 | (DE) . |
| 29 32 794 | 3/1980 | (DE) . |
| 32 07 461 A1 | 9/1983 | (DE) . |
| 34 23 539 A1 | 1/1985 | (DE) . |
| 0 461 812 A1 | 6/1991 | (DE) . |
| 41 27 602 A1 | 2/1993 | (DE) . |
| 42 03 774 A1 | 8/1993 | (DE) . |
| 44 15 581 A1 | 1/1995 | (DE) . |
| 295 08 421 U | 10/1995 | (DE) . |
| 0 461 812 A1 | 6/1991 | (EP) . |
| 0 643 168 | 3/1995 | (EP) . |
| 1 313 139 | 11/1962 | (FR) . |
| 2 522 631 | 3/1983 | (FR) . |

OTHER PUBLICATIONS

Die Papierfabrikation und ihre Maschinen by F. Muller. II. vol. 1938, p. 467.

* cited by examiner

*Primary Examiner*—Brenda A. Lamb
(74) *Attorney, Agent, or Firm*—Taylor & Aust, P.C.

(57) ABSTRACT

The invention is directed to a stationary sliding bar for guiding a paper or cardboard web extends across the entire web width B. Viewed in cross section, the sliding bar has a convex, rounded surface. Due to a relatively high speed of travel of the web, an aerodynamic flotation web forms between the sliding bar and the web.

11 Claims, 3 Drawing Sheets

Fig.5
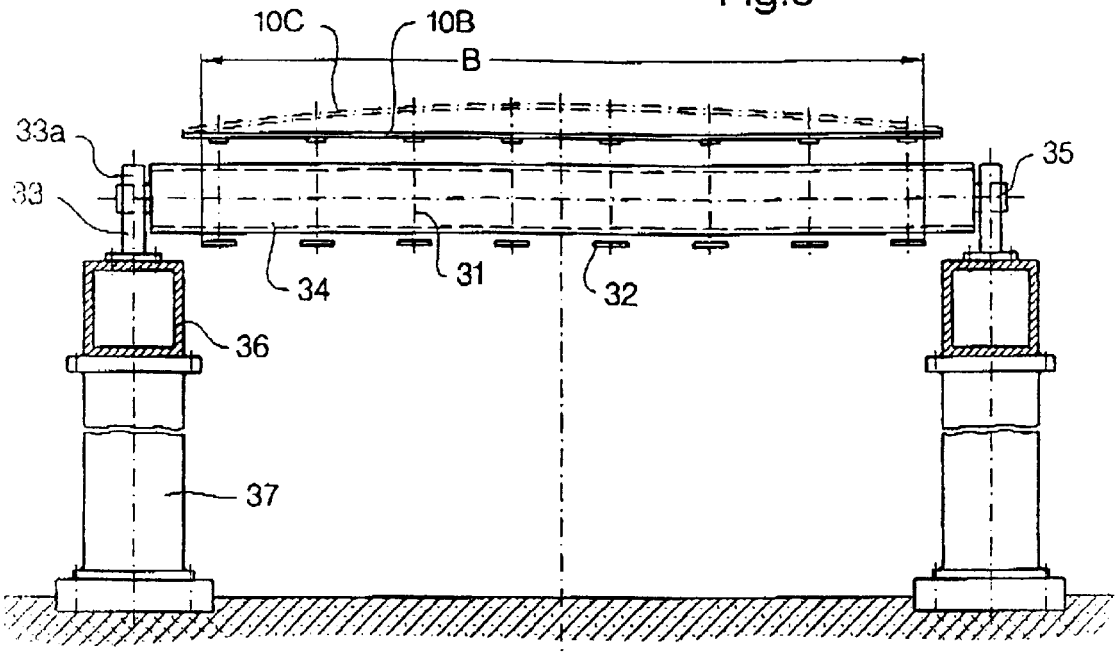
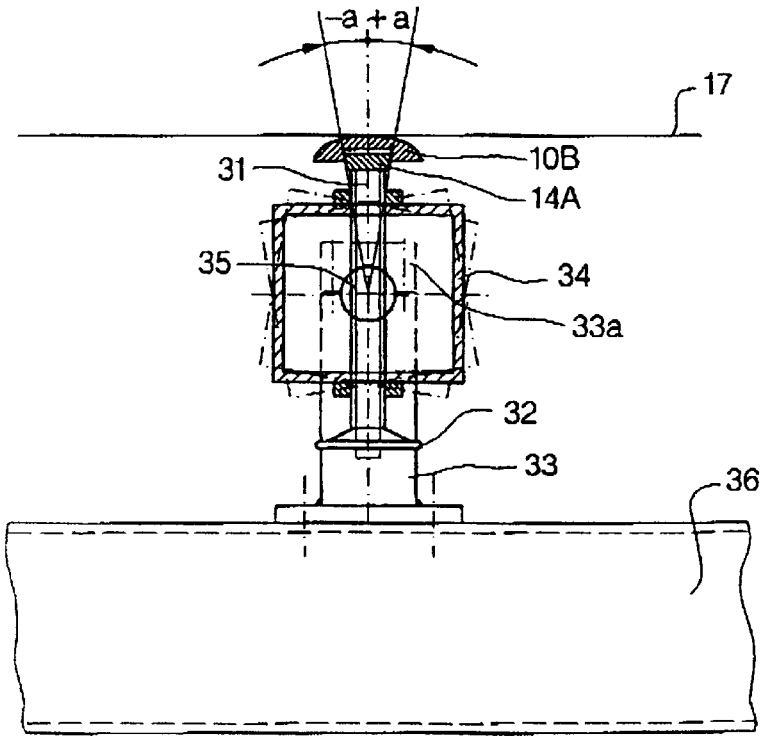
Fig.6

STATIONARY SLIDING BAR

This is a continuation of application Ser. No. 08/648,584, filed Jun. 3, 1996 now U.S. Pat. No. 5,855,672.

BACKGROUND OF THE INVENTION

1. Field of the Invention

The present invention relates to a stationary sliding bar for guidance of a traveling fiber material web, notably a paper or cardboard web.

2. Description of the Related Art

The textbook "Die Papierfabrikation und ihre Maschinen" [Paper Manufacture and Its Machines] by F. Müller. II. Vol. 1938, page 467, (Sketch No. 300) shows in the area of a rotary slitter a so-called non-slit web spreader, which after longitudinal slitting of the paper web passes the slit webs to a winding system.

EP 0 643 168 A1 discloses in FIGS. 3–6 a plurality of so-called air flotation beams, comprised each of a hollow profile beam which on its side away from the paper web has a plurality of blowing air orifices. These air flotation beams are normally arranged on the outlet end of a web coater, and at that, on the coated web side. Involving considerable expense to feed blowing air, care is taken that the fresh sized, and thus still moist, side of the paper web in no way makes direct contact with the air flotation beam.

SUMMARY OF THE INVENTION

The present invention provides a stationary sliding bar which guides a paper or cardboard web and has a relatively low-cost manufacture and, normally, application without active air supply.

An advantage of these measures is that, for one, the web being guided may temporarily or at times make contact with the surface of the sliding bar, but that the web, on the other hand, slides at sufficiently high speed of travel for the most—due to the creation of an aerodynamic floatation wedge—across the rounded, convex surface of the sliding bar without touching it. Hence, the inventional sliding bar is suited preferably for use wherever heretofore a rotatable web guide roll was required. Such guide rolls not only are expensive to fabricate, but also require routine maintenance. In contrast, considerable savings are achieved with the present invention.

Compared with conventional guide rolls, the stationary sliding bar according to the present invention has a low weight and no movable elements (no rotating mass), for which reason only a simplified support is needed. An additional major advantage is constituted in that the inventional sliding bar is insensitive to elevated temperature and temperature fluctuations.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein:

FIG. 5 is a schematical view of an embodiment of a lengthwise bowable sliding bar which additionally can be tilted; and FIG. 6 is a sectional view taken along line VI in FIG. 5.

Figure 1:
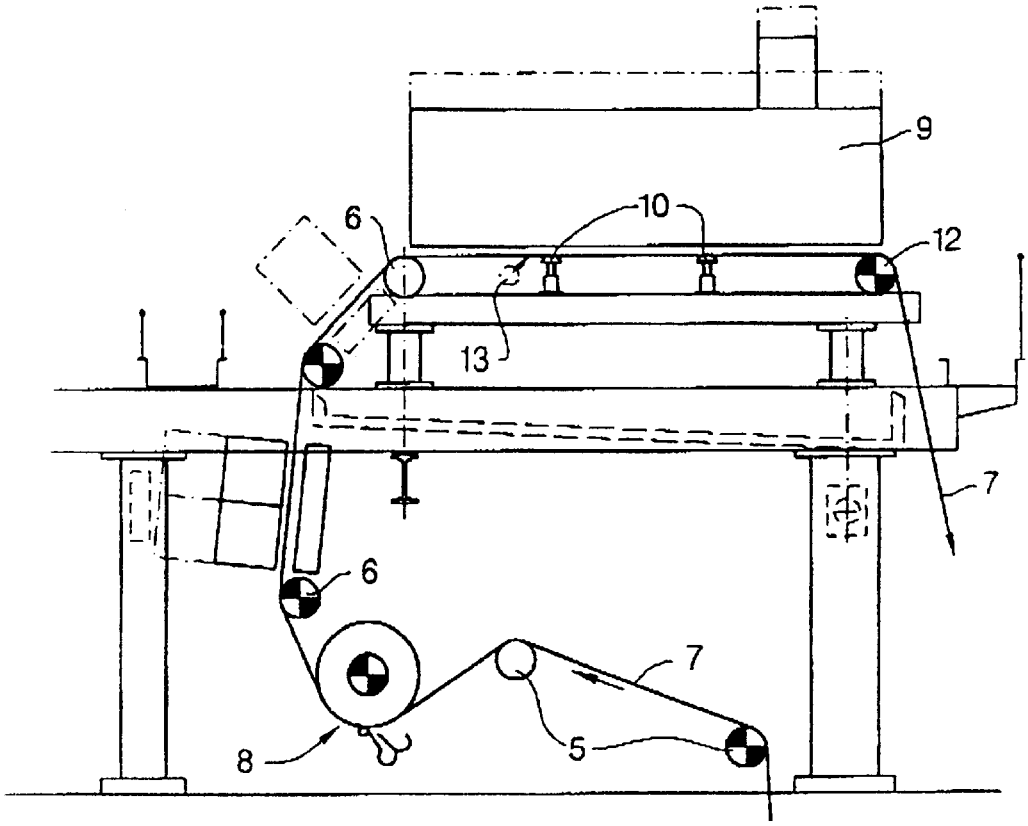
FIG. 1 is a side, sectional view of a coater for a paper or cardboard web with a pertaining dryer.

Corresponding reference characters indicate corresponding parts throughout the several views. The exemplifications set out herein illustrate one preferred embodiment of the invention, in, one form, and such exemplifications are not to be construed as limiting the scope of the invention in any manner.

DETAILED DESCRIPTION OF THE INVENTION

Referring now to the drawings and particularly to FIG. 1, there is shown a paper or cardboard web 7 which runs over web guide rolls 5 into a coater 8, and from there over further web guide rolls 6 and on to a drying unit 9. The web continues there along the underside of the drying unit, which is fashioned, e.g., as a rebound jet dryer and supported by a stationary sliding bar 10, to a further web guide roll 12. Part of the web guide rolls 5, 6 and the guide roll 12, the latter arranged at the end of the drying unit 9, are provided with drives illustrated only symbolically.

Figure 2:
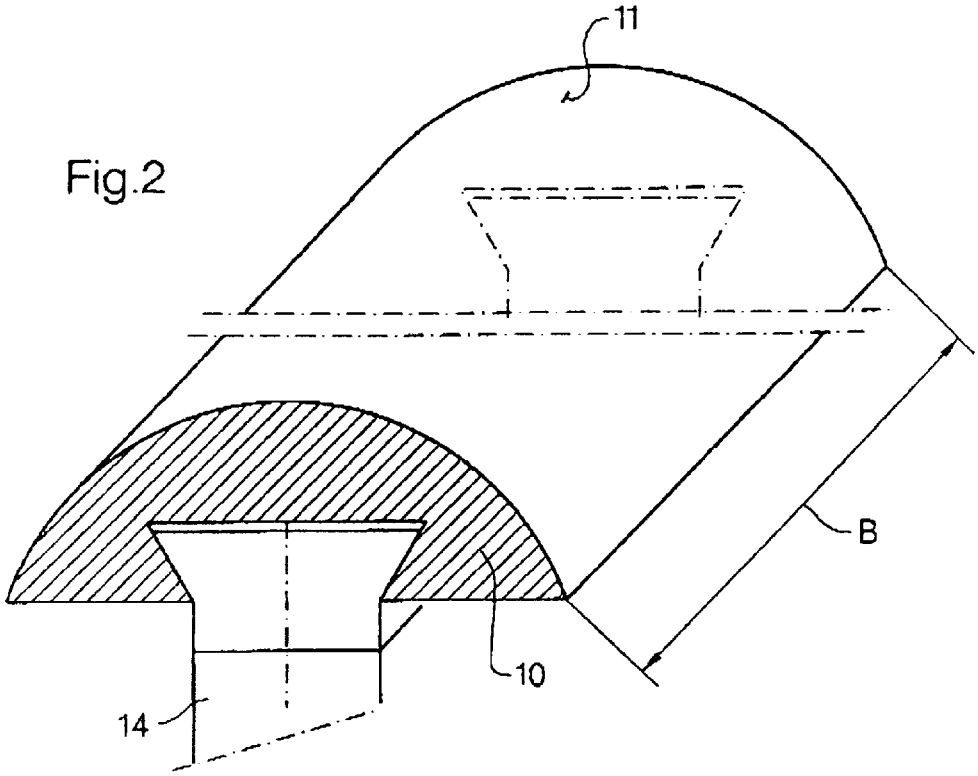
FIG. 2 is a schematical, perspective view of an embodiment of a stationary sliding bar shown in FIG. 1.

According to FIG. 2, the individual stationary sliding bar 10 is supported by several holders or a support bar 14. Stationary sliding bar 10 is so termed in that bar 10 is stationary within the system and the web slides therepast. Support bar 14 with sliding bar 10 mounted on it extends transverse across the entire width B of web 7. Sliding bar 10 has (viewed in cross section) a rounded, convex surface 11. The sliding bar 10 is preferably made of a common, inexpensive steel. Rounded surface 11 includes a support body of steel and a temperature-resistant plastic material mounted on the support body. Only the convex, rounded surface 11 is provided with a coating, for instance of a hard alloy or ceramic. If required, the coated surface 11 is polished. Surface 11 is thus insensitive to occasional touch by the traveling web 7. However, in the continuous operation of the system at a relatively high operating speed of web travel, a contact of the web 7 with the surface 11 of the sliding bars 10 is avoided in that the underside of the web carries a boundary layer of air along, as a result of which an aerodynamic flotation wedge forms on the approach side of each sliding bar 10.

An air feed system 13 may be provided, only for special cases, on the approach side of a sliding bar 10, as schematically indicated at 13. Such special case is concerned, e.g., as the system is ramped up from standstill or when the web travel speed is generally rather low. In some cases it will be sufficient to provide air feed devices only in the area of the two web edges.

The arrangement according to FIG. 1 is such that the top side of paper web 7 is sized in the coater 8 and subsequently dried by the drying unit 9, so that only the unsized web underside makes contact with the web guide rolls 6, 12 and occasionally or temporarily with the sliding bars 10. In other cases, however, a sliding bar may be arranged also on the sized side of the web, for instance, with a relatively slight sizing thickness.

According to FIG. 1, the underside of the rebound jet dryer 9 is flat. Therefore, the arrangement of the sliding bars 10 is such that web 7 travels along a substantially rectilinear stretch along the underside of dryer 9. Thus, web 7 is not (or not appreciably) deflected on the sliding bars.

Figure 3:
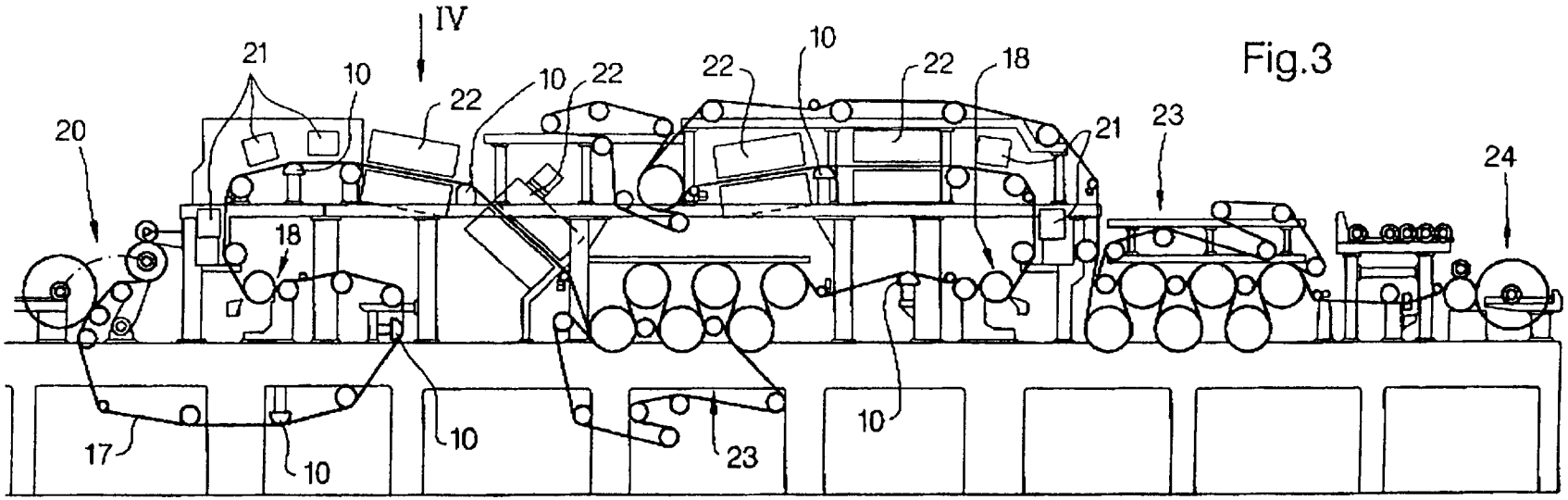
FIG. 3 is a schematical, side view of a complete off-line coater.

But the sliding bar according to the present invention is suited also for other applications where it is required to more or less heavily deflect the web being guided. As an example, reference is made to FIG. 3. It shows a complete off-line coater suited to coat relatively thin papers at very high running speeds. Arranged in the coater are several inventional stationary sliding bars 10 in positions where previously regular rotatable guide rolls were typically arranged. In detail, FIG. 3 depicts an unwinder 20 from which the paper web 17 runs to a coater 18 for the top side of the web, and thereafter past infrared dryers 21, through hot-air dryers 22 and through a drying cylinder group 23.

Next, web 17 runs through a second coater 18 for the underside and, once again, past infrared dryers 21, through a hot-air dryer 22 and through a second drying cylinder group 23, whereafter the web—now coated completely—is wound on a winder 24. As can be seen, the web deflection on each of the stationary sliding bars 10 ranges approximately between 5° and maximally about 40°. However, also a greater deflection may be provided for, for example, in the order of 90°.

Figure 4:
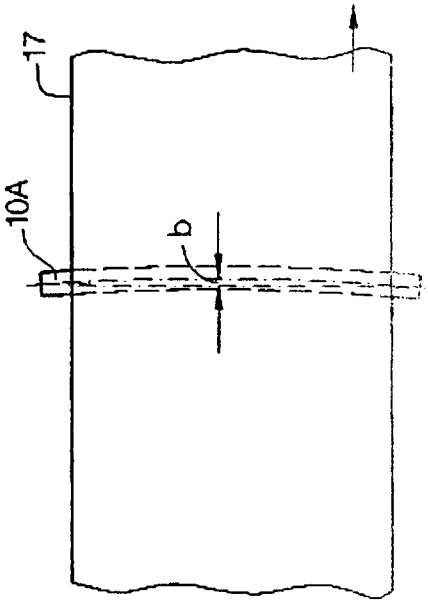
FIG. 4 is a partial view (in the direction of arrow IV in FIG. 3) of an embodiment of a curved sliding bar shown in relationship to the web.

FIG. 4 indicates schematically that a sliding bar 10A may be bowed about parallel to the direction of web travel. Effected thereby is a smoothing or "spreading" of the paper web 17 transverse to its direction of travel. The extent of the bowing "b" is variable with the aid of not illustrated bowing devices.

FIGS. 5 and 6 illustrate a sliding bar 10B which in a direction substantially perpendicular to the running direction of paper web 17 allows bowing or (in other words) vaulting. The width of the paper web is referenced B in FIG. 5. The following is provided for purposes of bowing sliding bar 10B: the sliding bar 10B (and, as the case may be, a support bar 14A joined to it) rests on several raising devices, e.g., threaded spindles 31. These are distributed uniformly across the length of the sliding bar and allow individual adjustment. The threaded spindles 31 bear on a beam 34 (e.g., square-section tubing). As illustrated, they may extend, e.g., transverse through the beam and can be adjusted by means of a handwheel 32 each. This allows selective adjustment of the bowing extent (or vaulting, e.g., upward). In FIG. 5, an upward-vaulted state of the sliding bar 10 is referenced 10C, as an example.

Extending parallel to sliding bar 10B, beam 34 has in the illustrated exemplary embodiment on each end a pivot pin 35, with the aid of which it rests in holders 33 with a clamp 33*a* each. The holders 33 are mounted, e.g., on longitudinal machine beams 36 supported by posts 37. Spindles 31 normally extend substantially perpendicularly to paper web 17. With the aid of the design described above, however, beam 34 may be pivoted along with the sliding bar 10B by a certain angle. The angle "a" may amount, e.g., up to 10°. By the described measures, namely bowing adjustment and/or tilting of sliding bar 10B, it is possible, in turn, to achieve a certain spreading of the paper or cardboard web.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. In a machine for one of making and off-line coating of a fiber material web, the fiber material web traveling through said machine, the improvement comprising:

a stationary bar for guiding the traveling web, said bar being configured to bow in a predetermined direction, said predetermined direction having at least a component substantially parallel to a direction of movement of the traveling web, said bar including a convex, rounded surface disposed adjacent to the traveling web, said rounded surface being at least one of substantially smooth and substantially continuous in a direction of movement of the traveling web, said rounded surface extending substantially across a width of the traveling web; and at least one powered web guide roll which carries and drives the traveling web at an operating speed which is sufficient to define an aerodynamic flotation wedge between said rounded surface and the traveling web, said rounded surface and said operating speed coacting to define a means for separating and preventing contact between the traveling web and said bar.

2. The machine according to claim 1, wherein said bar is comprised of steel.

3. The machine according to claim 1, wherein said rounded surface includes a coating of one of a metal and ceramic.

4. The machine according to claim 3, wherein said rounded surface is polished.

5. The machine according to claim 1, wherein said rounded surface comprises a support body of steel and a plastic material mounted on said support body.

6. The machine according to claim 5, wherein said plastic material comprises a temperature-resistant plastic material.

7. The machine according to claim 1, further comprising a web drying unit, and wherein said bar is disposed in an area of said web drying unit.

8. The machine according to claim 1, further comprising an air feed device disposed on an approach side of said bar.

9. The machine according to claim 8, wherein said air feed device is disposed only in an edge area of the web.

10. The machine according to claim 1, wherein said bar is configured for deflecting the traveling web at an angle between 2 and 120 degrees.

11. The machine according to claim 1, wherein said bar is configured for deflecting the traveling web at an angle between 5 and 40 degrees.

* * * * *

UNITED STATES PATENT AND TRADEMARK OFFICE

CERTIFICATE OF CORRECTION

PATENT NO. : 6,174,368 B1
DATED : January 16, 2001
INVENTOR(S) : Eichinger et al.

It is certified that error appears in the above-identified patent and that said Letters Patent is hereby corrected as shown below:

Title page,
Item [54], column 1,
In the title, delete "SLIDING";

Under U.S. PATENT DOCUMENTS, second reference, delete "10/1987" and insert -- 6/1987 --.

Column 1,
Line 1, delete "SLIDING".

Signed and Sealed this

Sixteenth Day of October, 2001

*Attest:*

Nicholas P. Godici

NICHOLAS P. GODICI
*Acting Director of the United States Patent and Trademark Office*

*Attesting Officer*